US009611448B2

(12) United States Patent
Moragas Arjant et al.

(10) Patent No.: US 9,611,448 B2
(45) Date of Patent: Apr. 4, 2017

(54) ALKALINE CLEANING COMPOSITIONS FOR NON-HORIZONTAL SURFACES

(71) Applicant: KAO Corporation, S.A., Barbera del Valles (ES)

(72) Inventors: Elizabet Moragas Arjant, Barbera del Valles (ES); Blanca Nogues Lopez, Barbera del Valles (ES)

(73) Assignee: KAO Corporation, S.A., Barbera Del Valles (ES)

( * ) Notice: Subject to any disclaimer, the term of this patent is extended or adjusted under 35 U.S.C. 154(b) by 3 days.

(21) Appl. No.: 14/373,652

(22) PCT Filed: Jan. 18, 2013

(86) PCT No.: PCT/EP2013/050911

§ 371 (c)(1),
(2) Date: Jul. 22, 2014

(87) PCT Pub. No.: WO2013/110551

PCT Pub. Date: Aug. 1, 2013

(65) Prior Publication Data

US 2015/0011455 A1 Jan. 8, 2015

(30) Foreign Application Priority Data

Jan. 23, 2012 (EP) ..... 12382019

(51) Int. Cl.

| | |
|---|---|
| ***C11D 1/06*** | (2006.01) |
| ***C11D 1/75*** | (2006.01) |
| ***C11D 1/94*** | (2006.01) |
| ***C11D 3/20*** | (2006.01) |
| ***C11D 1/825*** | (2006.01) |
| ***C11D 1/83*** | (2006.01) |
| ***C11D 3/00*** | (2006.01) |
| ***C11D 10/04*** | (2006.01) |
| ***C11D 17/00*** | (2006.01) |
| *C11D 1/14* | (2006.01) |
| *C11D 1/29* | (2006.01) |
| *C11D 1/72* | (2006.01) |

(52) U.S. Cl.

CPC ..... *C11D 3/2089* (2013.01); *C11D 1/825* (2013.01); *C11D 1/83* (2013.01); *C11D 1/94* (2013.01); *C11D 3/0094* (2013.01); *C11D 3/202* (2013.01); *C11D 3/2013* (2013.01); *C11D 3/2031* (2013.01); *C11D 10/042* (2013.01); *C11D 10/045* (2013.01); *C11D 17/0017* (2013.01); *C11D 1/06* (2013.01); *C11D 1/146* (2013.01); *C11D 1/29* (2013.01); *C11D 1/72* (2013.01); *C11D 1/75* (2013.01)

(58) Field of Classification Search

CPC .... C11D 1/06; C11D 1/72; C11D 1/75; C11D 1/83; C11D 1/88; C11D 1/94; C11D 3/02; C11D 3/2013; C11D 3/30; B08B 3/04

USPC ... 510/191, 238, 423, 435, 505, 506; 134/42

See application file for complete search history.

(56) References Cited

U.S. PATENT DOCUMENTS

| | | | | |
|---|---|---|---|---|
| 5,269,974 | A | 12/1993 | Ofosu-Asante | |
| 5,415,814 | A | 5/1995 | Ofosu-Asante et al. | |
| 5,426,961 | A | 6/1995 | Rimbaud et al. | |
| 5,698,505 | A | 12/1997 | Ofosu-Asante | |
| 5,739,092 | A | 4/1998 | Ofosu-Asante | |
| 5,906,973 | A | 5/1999 | Ouzounis et al. | |
| 6,172,021 | B1 | 1/2001 | Ofosu-Asante et al. | |
| 6,828,294 | B2 | 12/2004 | Kellar et al. | |
| 2006/0263239 | A1* | 11/2006 | Tichy | A01N 59/16 422/28 |
| 2007/0048175 | A1* | 3/2007 | Tichy | A01N 59/16 422/28 |
| 2011/0021399 | A1* | 1/2011 | Smith | C11D 3/046 510/161 |
| 2011/0160116 | A1* | 6/2011 | Mckechnie | C11D 1/66 510/362 |
| 2011/0278194 | A1* | 11/2011 | Zhu | C11D 1/02 206/524.7 |
| 2013/0137618 | A1* | 5/2013 | Wood | C11D 1/65 510/109 |

FOREIGN PATENT DOCUMENTS

| | | | |
|---|---|---|---|
| DE | 19907376 | A1 | 8/2000 |
| EP | 0314232 | A2 | 7/1990 |
| EP | 0928829 | B1 | 9/2003 |
| WO | WO94/05769 | * | 3/1994 |
| WO | WO98/28392 | * | 7/1998 |

OTHER PUBLICATIONS

PCT/EP2013/050911, International Search Report, Mar. 18, 2013.

* cited by examiner

*Primary Examiner* — Gregory R Delcotto

(74) *Attorney, Agent, or Firm* — Timothy J. Monahan; Monahan & Company, LLC

(57) ABSTRACT

The present invention relates to cleaning compositions suitable for cleaning and disinfecting non-horizontal surfaces. The invention comprises an ether carboxylate or ether sulphate in combination with an amphoteric surfactant and with a non-ionic surfactant at a certain ratio which can be applied preferably in the form of foam at room temperature, preferably for the use in industrial and institutional cleaning products.

A cleaning composition comprises:

(a) One or more compounds of formula (I)

$$R^1—O—(CH_2—CH(R^2)—O)_n(CH_2CH_2O)_m—X^-(A)_{1/z}^{z+} \quad (I)$$

wherein $X^-$ is a $CH_2COO^-$ group or a $SO_3^-$ group, preferably a $CH_2COO^-$ group, R1 is linear or branched, saturated or unsaturated alkyl or alkenyl chain having from 4 to 30 carbon atoms, R2 is a C1-C3 linear or branched alkyl chain, A is a suitable countercation, n and m are 0 or an integer number between 1 to 30, wherein the sum of m+n is at from 0 to 30, preferably from 1 to 15, and z is 1, 2, or 3;

(b) one or more amphoteric surfactants (c) a non-ionic surfactant (d) water up to 100 wt % with respect to the total weight of the composition wherein the molar ratio between the sum of the components (a) and (b) and component (c), that is ((a)+(b))/(c), is from 3 to 16.5, preferably from 3.7 to 15.9.

17 Claims, No Drawings

ALKALINE CLEANING COMPOSITIONS FOR NON-HORIZONTAL SURFACES

FIELD OF THE INVENTION

The present invention relates to cleaning compositions suitable for cleaning and disinfecting non-horizontal surfaces. The present invention provides an ether carboxylate or ether sulphate in combination with an amphoteric surfactant and with a non-ionic surfactant at a certain ratio which can be applied preferably in the form of foam at room temperature, preferably for the use in industrial and institutional cleaning products.

STATE OF THE ART

The cleaning of hard surfaces in the industrial, social or communal sectors, such as those related to industrial and institutional cleaning, like in the industrial food production, particularly within the industrial meat production, require products which can be easily applied and removed while being highly efficient regardless of the inclination of the treated surfaces. In order that the product meets all those requirements and is useful for the cleaning in said applications, it has to share at least four main features:

High retention over the treated surfaces: the longer the contact time of the cleaning product with the treated surface, the better the cleaning efficiency.

Feasible formulation: the stability of the products formulated at high or low concentration is an advantage.

Robust performance regardless of the water electrolyte contents (salinity/hardness) and temperature variations.

Suitability to be in contact with alimentary treatment devices.

The first point, namely the high retention over the treated surfaces, is considered to be a key point having the greatest impact on the cleaning product efficiency.

One of the solutions proposed in the art to address the high retention time requirement is the formulation of highly viscous products able to adhere over a longer period onto the treated surface. In order to accomplish with the formulation feasibility mentioned above, it is an advantage if these formulations exhibit special rheological properties, namely concentrated products having relatively low viscosity which thicken upon dilution to working concentrations, i.e. upon dilution to the application conditions, usually forming a gel-like foam at said working concentrations. The non-viscous character of the concentrates is an advantage when it comes to handling, pumping, etc. In this regard, European patent application EP0314232 A2 discloses compositions based on four main ingredients a), b) c) and d), defined as follows:

a) A primary surfactant material which comprises one or more agents selected from amine, amine oxide, betaine and quaternary ammonium surfactant compounds;

b) A co-surfactant material which is a hydrotrope for the primary surfactant material: the co-surfactant component is preferably an anionic surfactant compound, especially preferred are those selected from: (i) alkali metal salts of polyalkoxylated alkyl- or arylalkyl-sulphates or -sulphonates, in which the alkyl moiety has from 12 to 16 carbon atoms; and (ii) alkali metal or alkaline earth metal salts of benzene or naphthalene sulphates or sulphonates which are mono- or polyalkoxylated on the aryl moiety thereof, with a, or a plurality of independently selected, C1-4 alkyl groups. Of the polyalkoxylated co-surfactants compounds (i), those containing from 3 to 7 ethylene oxide groups are normally the most suitable;

c) One or more water-soluble or water-miscible, non-surfactant compounds which are ionisable in water;

d) water.

The invention disclosed incorporates also a method of spraying a target surface with such a composition after dilution, e.g. in the form of a foam. Still, the active matter of the diluted formula disclosed therein is rather high, which is an undesirable feature from both the economic and environmental point of view.

European patent application EP0550590 discloses an aqueous concentrate suitable for dilution with water to form a viscous cleaning solution, comprising:

(a) an amine oxide;

(b) an alkyl anionic surfactant selected from the group consisting of ammonium and alkali metal salts of the alkyl sulfates, olefin sulfonates, alkylether sulfates, alkylaryl sulfonates, alkylarylether sulfates, alkylarylether sulfonates and mixtures thereof, wherein said alkyl groups are minimally C12 when aryl groups are not present, and wherein said alkylaryl groups are minimally C16, and wherein said ether groups comprise a polyoxyalkylene group containing from 2 to 4 C2 to C4 alkylene oxide residues;

(c) a hydrophobically modified polymer surfactant;

(d) a thinner selected from the group consisting of lower alkanols, lower alkanol ethers, and nonionic surfactants prepared by oxyalkylating an alkylphenol or fatty alcohol with from 4 to 10 C2-C3 alkylene oxide moieties.

In the same line, U.S. Pat. No. 5,906,973 discloses a process for cleaning vertical or inclined hard surfaces, said process comprises a step of applying a cleaning solution to said hard surfaces that consists of a solution in water of from 2 to 10% by weight of a concentrated cleaning formulation comprising: (a) 0.5 to 10% by weight of one or more tertiary amine oxides (b) 0.5 to 10% by weight of one or more alkyl polyglycosides and (c) 1 to 15% by weight of one or more water-soluble organic solvents selected from the group of monohydric or polyhydric alcohols, glycol ethers and alkanolamines; and for the balance water or an aqueous solution of other auxiliaries and active substances, said cleaning solution having a higher viscosity than said concentrated cleaning formulation, so that the cleaning solution, after it has been applied to the vertical or inclined hard surface to be cleaned, remains in contact with said vertical or inclined hard surface over a longer period.

Further, WO 94/05769 discloses liquid or gel dishwashing detergent compositions containing high amounts of alkyl ethoxy carboxylate surfactants, Ca or $Mg^-$ ion, and alkylpolyethoxypolycarboxylate surfactants.

U.S. Pat. No. 5,415,814 relates to concentrated liquid or gel dishwashing detergent compositions containing surfactants and Ca-ions. In the example compositions comprising high amounts of alkyl ether carboxylates are disclosed.

WO 95/20027 discloses high sudsing light duty liquid or gel dishwashing detergent compositions containing long chain amine oxide. These compositions may contain C8-22 alkyl sulfates, but no alkyl ether carboxylates.

U.S. Pat. No. 5,269,974 discloses liquid or gel dishwashing detergent compositions containing alkyl amphocarboxylic acid or $Hg^-$ or $Ca^-$ ions. No alkyl ether carboxylates are contained in such composition.

WO 98/28392 discloses dishwashing detergent compositions containing alkanolamine. No alkyl ether carboxylates are contained in the disclosed compositions.

DE 199 07 376 relates to liquid detergent composition for the human body, containing at least one anionic surfactant, at least a non-ionic surfactant and an organic salt of formula (I), selected from sulfates, sulfonates, carboxilates and alkylphosphates.

Definitely, several authors seem to have succeeded in addressing the problem of obtaining a cleaning composition thickening upon dilution suitable for cleaning non-horizontal hard surfaces. However, one of the drawbacks of this approach is that, even though high retention times onto non-horizontal surfaces are achieved, the rinsing behavior is often not satisfactory because of: i) the high viscosity of the product and ii) the relatively high quantity of active substances needed per area of treated surface. Thus, a different approach to achieve the high retention of the cleaning product on the treated surface would be to apply said cleaning compositions in the form of low density foam providing high surface coverage with a relatively low amount of the product. In this approach, it is relevant to consider both the behavior of the composition as a material for the generation of the foam and the characteristics as well as the behavior of the foam once applied to the treated surface.

The first consideration relates therefore to the foam generation step which is obviously in connection with the device used to generate the foam. Although there are several options for this device to operate, it is in any case necessary to mix air with the liquid cleaning composition in the proper proportions. In this regard, one clear point is that the composition suitable for the foam generation shall not be too viscous since this may lead to the obstruction of the pumping channels and would make the foam generation difficult. On the other hand, if the highly viscous composition exhibits a thixotropic behavior it may lead to the assumption that the obstruction problem can be avoided. A thixotropic behavior means that the viscosity is reduced under the mechanical strength, like that applied by the pumping devices. However, it is known that when a thixotrophic liquid composition is applied in the form of foam, the viscosity normally drops at a rapid pace which renders the porous diameter of the generated foam to be too big. This, in turn, favors liquefaction of the foam, which causes the retention time to be not satisfactory and the foam stability to be low. Indeed, foam stability is a key factor for compositions applied in the form of foam. This point leads to the second consideration mentioned above.

This second aspect concerns the behavior of the foam, once generated, on the treated surface. The mechanism of foam rupture, which causes foam instability, has been deeply studied. The more general approach is the consideration of an isolated foam film and the study of the mechanism of rupture of such a film. Said mechanism involves the interactions of the foam lamellae and the liquid channels limiting the foam lamellae. The liquid drained to said liquid channels in conjunction with the interaction of the foam with the environment play a main role. At the first stage, when the foam is generated, little rupture normally occurs. Later, the foam film experiences gradual thinning which leads to final rupture when, locally, the film thickness lowers until a few nanometers. The presence of surfactants in the foam films helps to delocalize thinning though general thinning still occurs. The presence of the surfactants provides a certain stability to the film which leads to an improved foam stability.

In the state of the art are several attempts directed to provide cleaning compositions suitable to generate foam efficiently regardless of the inclination of the treated surface by solving the foam stability problem.

The European patent EP0928829 addresses the foam stability problem by providing an alkaline composition with a rheopectic viscosity profile comprising a quaternary ammonium compound, an alkyl glucoside, an alkaline substance and a solvent, namely an alcohol or a glycol ether. The authors claim that this composition allows obtaining a thin foam, finely porous with a high stability.

U.S. Pat. No. 6,828,294 B2 points to the problems of highly viscous compositions being used as the carrier for sanitizer additives such as peracetic acid. The authors disclose two types of compositions which claim to provide stable foams with high retention times and which are particularly suitable to be applied at relatively acid pH conditions. The compositions comprise (a) water; (b) about 1 ppm to about 3000 ppm of an antimicrobial agent; and (c1) or (c2);

being (c1) a retention aid comprising about 0.01 wt % to about 3.0 wt % of a mixture of a non-ionic surfactant and an anionic surfactant; wherein: the non-ionic surfactant has a polar non-ionic group attached to a first alkyl group having 8 to 20 carbon atoms; the anionic surfactant has an anionic group attached to a second alkyl group having 8 to 20 carbon atoms; and the ratio of the non-ionic surfactant to the anionic surfactant is about 0.1:1 to about 0.5:1;

being c2) a retention aid comprising (i) about 0.025 wt % to about 1.0 wt % of a biopolymer thickening agent and (ii) about 0.01 to 3.0 wt % of at least one surfactant.

To conclude, it is clear to the inventors of the present invention disclosed hereinafter that there is still a need for:

Providing a foam suitable for cleaning non-horizontal hard surfaces, said foam being characterized in:

a) High retention times over non-vertical surfaces
b) High quality (excellent economical and ecological profile): suitable density so that only a low amount of the product is needed to generate the foam required to cover a given area of the treated hard surface.
c) Robust performance regardless of the water electrolyte contents (salinity or water hardness) and temperature variations.

SUMMARY OF THE INVENTION

According to a first aspect the present invention provides a cleaning composition suitable for horizontal and non-horizontal surfaces comprising:

(a) One or more compounds of formula (I)

$$R^1—O—(CH_2—CH(R^2)—O)_n(CH_2CH_2O)_m—X^-(A)_{1/1}^{z+} \quad (I)$$

wherein $X^-$ is a $CH_2COO^-$ group, R1 is a linear or branched, saturated or unsaturated, alkyl or alkenyl chain having from 4 to 30 carbon atoms, R2 is a C1-C3 linear or branched alkyl chain, A is a suitable counter-cation, n and m are 0 or an integer number between 1 to 30, the sum of m+n is from 0 to 30, preferably from 1 to 15, and z is 1, 2 or 3, (b) One or more amphoteric surfactants
(c) A non-ionic surfactant
(d) Water up to 100 wt % with respect to the total amount of the composition;

wherein the molar ratio between the sum of components (a) and (b) and component (c), that is ((a)+(b))/c, is from 3 to 16.5, preferably from 3.7 to 15.9, and the molar percentage of the components (a) and (c), calculated taking as a whole the sum of (a)+(b)+(c) are: (a) is from 15 to 60 mol. % and (c) is from 7 to 16 mol. %.

The cleaning composition of the present invention can be provided as a concentrated cleaning composition with an active matter content corresponding to the sum of the active matter of components (a), (b) and (c) from 15.0 to 90.0 wt. % with respect to the total amount of the composition; as a diluted cleaning composition having an active matter content corresponding to the sum of the active matter of components (a), (b) and (c) from 1.5 to less than 15.0 wt. % with respect to the total amount of the composition and optionally comprising an alkaline additive; or as a highly diluted cleaning composition, having an active matter content corresponding to the sum of the active matter of components (a), (b) and (c) from 0.01 to less than 1.5 wt. % active matter, preferably from 0.1 to 0.6 wt. %, with respect to the total amount of the composition, and optionally comprising an alkaline additive, which is suitable to generate a cleaning foam without further dilution.

According to a further aspect, the present invention provides a method to prepare a concentrated, a diluted or a highly diluted cleansing composition according to the invention as hereinabove defined.

According to a further aspect, the present invention provides a method of cleaning and optionally disinfecting a horizontal and/or non-horizontal surface comprising contacting said surface with a high retention foam generated by using a diluted or a highly diluted, preferably a highly diluted, cleaning composition as hereinbefore defined.

The inventors of the present invention have found that the cleansing compositions based on the particular ingredients at the particular ratios according to the invention are able to provide outstanding foam properties while being compatible with the other requirements for industrial and institutional cleaning as detailed above, providing substantial advantages compared to the compositions known in the art. In particular, the claimed compositions

- have a low viscosity at both high and low concentrations, facilitating the handling and avoiding potential obstruction problems of application systems and devices;
- are stable at high concentrations so that they have the benefits of dilutable formulations as to the reduction of transportation costs and of the presence of preservatives in the formulation;
- are compatible with alkaline pHs at the applications conditions, a feature that makes not necessary adding high charges of cleaning and disinfecting compounds in addition to the composition surfactant basis;
- are compatible with disinfecting agents when needed.

DETAILED DESCRIPTION OF THE INVENTION

The present invention provides a cleaning composition suitable for horizontal and non-horizontal surfaces comprising:

(a) One or more compounds of formula (I)

$$R^1—O—(CH_2—CH(R^2)—O)_n n(CH_2CH_2O)_m—X^-(A)_{1/z}^{z+} \quad (I)$$

wherein $X^-$ is a $CH_2COO^-$ group, $R^1$ is a linear or branched alkyl or alkenyl chain having from 4 to 30 carbon atoms, $R^2$ is a C1-C3 linear or branched alkyl chain, A is a suitable countercation, n and m are 0 or an integer number between 1 to 30, and wherein the sum of m+n is from 0 to 30, preferably from 1 to 15, and z is 1, 2 or 3, (b) One or more amphoteric surfactants (c) A non-ionic surfactant (d) Water up to 100 wt % with respect to the total amount of the composition;

wherein the molar ratio between the sum of components (a) and (b) and component (c), that is ((a)+(b))/c, is from 3 to 16.5, preferably from 3.7 to 15.9, and the molar percentage of the components (a) and (c), calculated taking as a whole the sum of (a)+(b)+(c) are: (a) is from 15 to 60 mol. % and (c) is from 7 to 16 mol. %.

The Component (a)

The composition according to the invention comprises a component (a). The component (a) comprises one or more compounds of Formula (I):

$$R^1—O—(CH_2—CH(R^2)—O)_n(CH_2CH_2O)_m—X^-(A)_{1/z}^{z+} \quad (I)$$

wherein $X^{-1}$ is a $CH_2COO^-$ group, $R^1$ is a linear or branched, saturated or unsaturated alkyl alkenyl chain having from 4 to 30 carbon atoms, $R^2$ is a C1-C3 linear or branched alkyl chain, A is a suitable countercation, n and m are 0 or an integer number between 1 to 30, and wherein the sum of m+n is from 0 to 30, preferably from 1 to 15 z is 1, 2 or 3.

The component (a) preferably consists of one, two or more compounds of Formula (I).

Compounds of Formula I can be used alone or in combination as component (a).

Alkyl Ether Carboxylates

The group $X^-$ in formula (I) is a $CH_2$—$COO^-$ group, so that the compound of formula (I) of formula I.2 is an alkylethercarboxylate hereinbelow defined:

$$R^1—O(CH_2—CH(R^2)—O)_n(CH_2CH_2O)_m—CH_2COO^-(A)_{1/z}^{z+} \quad (I.2)$$

wherein $R^1$ is a linear or branched alkyl or alkenyl chain having from 4 to 30 carbon atoms, preferably between 8 and 18 carbon atoms, more preferably between 12 and 14 carbon atoms; $R^2$ is a C1-C3 linear or branched alkyl chain, A is a suitable countercation, n and m are 0 or an integer number between 1 to 30, and wherein the sum of m+n is from 0 to 30, preferably from 1 to 15, and z is 1, 2 or 3.

The compounds of formula (I.2) are usually obtained by a process comprising the alkoxylation of an alcohol and subsequent carboxymethylation, as described by Meijer and Smid in *Polyether Carboxylates*; Anionic Surfactants; Surfactant Sciencie Series, Vol. 56 (p. 313-361), edited by Helmut W. Stache, ISBN: 0-8247-9394-3.

The alkoxylation of alcohols can be carried out under standard conditions known by persons skilled in the art. For instance, the polyoxyethylene group is obtained by the addition of ethylene oxide to fatty alcohols, mostly with an alkaline catalyst such as NaOH, KOH or $NaOCH_3$, giving a broad polyoxyethylene oxide distribution (broad ethoxylation degree). For special applications the ethoxylation can be catalyzed by Lewis acids or by using metallic Na or NaH to achieve a narrow range distribution (narrow ethoxylation degree). However, one may also start from commercially available ethoxylated alcohols.

In the second step, the ethoxylated alcohols are reacted with a strong base, like sodium or potassium hydroxide, in the presence of a reducing agent, e.g. sodium borohydride, to obtain the corresponding alkoxylate, which is carboxymethylated with sodium monochloroacetate (SMCA).

The ether carboxylates of Formula (I.2) are derived from $C_4$-$C_{30}$ alcohols, preferably $C_4$-$C_{22}$ alcohols, more preferably from $C_8$-$C_{18}$ alcohols, even more preferred from $C_8$-$C_{16}$ alcohols, most preferred from $C_{12}$-$C_{14}$. It is preferred that the $C_4$-$C_{30}$ alcohols correspond to n-butanol, n-hexanol, n-octanol, 2-ethylbutanol, 2-methylpentanol, 2-ethylhexanol, 2-methylheptanol, n-decanol, 2-methyl-4-nonanol, 3,7-dimethyl-3-octanol, 3,7-dimethyl-1-octanol, 3,6-dimethyl-3-octanol, lauryl alcohol (1-dodecanol), myristyl alcohol (1-tetradecanol), cetyl alcohol (1-hexadecanol), palmitoleyl alcohol (cis-9-hexadecan-1-ol), stearyl alcohol (1-octadecanol), isostearyl alcohol (16-methylheptadecan-1-ol), elaidyl alcohol (9E-octadecen-1-ol), oleyl alcohol (cis-9-octadecen-1-ol), linoleyl alcohol (9Z,12Z-octadecadien-1-ol), elaidolinoleyl alcohol (9E,12E-octadecadien-1-ol), linolenyl alcohol (9Z,12Z,15Z-octadecatrien-1-ol), elaidolinolenyl alcohol (9E,12E,15-E-octadecatrien-1-ol), ricinoleyl alcohol (12-hydroxy-9-octadecen-1-ol), arachidyl alcohol (1-eicosanol), behenyl alcohol (1-docosanol), erucyl alcohol (cis-13-docosen-1-ol) or mixtures thereof.

It is preferred that the ether carboxylates of Formula (I) are prepared from alcohols comprising lauryl alcohol, myristyl alcohol (1-tetradecanol), or mixtures thereof.

The ether carboxylates of Formula (I) are preferably derived from alcohols obtainable from natural fats and oils. Preferred fats and oils include palm oil, coconut oil, sunflower oil, rapeseed oil, castor oil, olive oil, soybean oil, animal fat such as tallow, fish oil, hardened oils and semi-hardened oils thereof, and mixtures thereof. As a result of their natural origin, the alcohols that are alkoxylated and subsequently carboxymethylated may contain a great variety of alkyl or alkenyl groups, said groups being linear or branched, saturated or unsaturated. The ether carboxylates of Formula (I.2) are preferably obtained from C8-C18 fatty alcohols derived from coconut oil, palm oil and olive oil. It is particularly preferred that the $C_8$-$C_{18}$ fatty alcohols that are alkoxylated and subsequently carboxymethylated are derived from vegetal oils.

Furthermore, it is also preferred that more than one of compounds of Formula (I.2) is present in the composition according to the invention, the proportion having $R_1$ $C_{12}$ or $C_{14}$ being higher than 60 wt. %, more preferred higher than 80 wt. %, even more preferred higher than 85 wt. %.

According to the invention, it is preferred that in the ether carboxylates of Formula (I.2), m has a value in the range of 0 to 15, preferably in the range of 0 to 12, more preferably 0 to 3.

According to the invention, it is preferred that in the ether carboxylates of Formula (I.2), n has a value in the range of 1 to 30, preferably in the range of 1 to 15, more preferably in the range 1 to 12, even more preferred in the range 1 to 7, more preferably 1 to 5, most preferred lower than 4. In the context of the present invention, the ether carboxylic acids may be both ethoxylated and propoxylated. The order or sequence of the groups is not critical to the invention. Accordingly, both compounds corresponding to formula (I), which contain ethylene oxide groups and/or propylene oxide groups, are suitable for the composition according to the invention. For those compounds of formula (I) having both ethylene oxide groups and propylene oxide groups, these groups could be organised in separated blocks or randomly distributed.

In a specially preferred embodiment of the invention the compound a) of the composition according to the invention consists in one or more ether carboxylates of Formula (I.2), wherein n has a value in the range of 1 to 30, preferably in the range of 1 to 15, more preferably in the range 1 to 12, even more preferred in the range 1 to 7, more preferably 1 to 5, most preferred lower than 4.

Examples of commercially available ether carboxylates of Formula (I) are AKYPO® LF 1 (Caprylic ether carboxylic acid with an average ethoxylation degree of 5) , AKYPO® LF 2 (Caprylic ether carboxylic acid with an average ethoxylation degree of 8), AKYPO® LF 4 (a mixture of caprylic and caproic ether carboxylic acids with an average ethoxylation degree of 8 and 3 respectively), and AKYPO® LF 6 (a mixture of caprylic and butyric ether carboxylic acids with an average ethoxylation degree of 8 and 1 respectively, AKYPO® RLM 25 (Lauric ether carboxylic acid with an ethoxylation degree of 3), AKYPO® RLM 45 (lauric ether carboxylic acid with an ethoxylation degree of 4.5), AKYPO® RLM 100 (Lauric ether carboxylic acid with an ethoxylation degree of 10), AKYPO® RO 10 VG (Oleic ether carboxylic acid with an average ethoxylation degree of 1), AKYPO® RO 20 VG (Oleic ether carboxylic acid with an average ethoxylation degree of 2), AKYPO® RO 50 VG (Oleic ether carboxylic acid with an average ethoxylation degree of 5), and AKYPO® RO 90 VG (Oleic ether carboxylic acid with an average ethoxylation degree of 9), all marketed by Kao Chemicals Europe.

The Component (b)

The composition according to the invention comprises a component b) which comprises one or more amphoteric surfactants. Amphoteric surfactants include ampholytes and betaines.

In a preferred embodiment the component b) of the composition according to the invention comprises one or more betaines. Specific examples of betaines are alkyl betaines, alkyl sulphobetaines (sultaines), amidoalkyl betaines, alkyl glycinates, alkyl carboxyglycinates, alkyl amphoacetates, alkyl amphopropionates, alkylamphoglycinates, alkyl amidopropyl betaines and hydroxysultaines. Particularly preferred betaines are alkyl amidopropyl betaines, alkyl amidopropyl hydroxysultaines, alkyl hydroxysultaines and alkyl amphoacetates In a preferred embodiment the betalnes are alkyl hydroxysultaines. Examples of commercially available useful amphoteric surfactants according to the invention are BETADET® HR, BETADET® HR-50K, BETADET® S-20, BETADET® SHR and BETADET® THC-2, all marketed by Kao Chemicals Europe.

In a preferred embodiment of the invention the component b) of the composition according to the invention comprises one or more ampholytes. Specific examples of ampholytes are amine oxides. Suitable amine oxides according to the present invention are amine oxides with a hydrocarbon chain containing between 8 and 18 carbon atoms. The amine oxides of Formula (II) are especially preferred Formula (II)

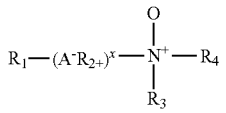

wherein $R_1$ represents a linear or branched, saturated or unsaturated alkyl or alkenyl group containing between 8 and 18 carbon atoms;

$R_2$ represents an alkylene group containing between 1 and 6 carbon atoms;

A represents a group selected from —COO—, CONH—, —OC(O)— and —NHCO—;

x represents 0 or 1;

and $R_1$ and $R_4$ independently of one another represent an alkyl or hydroxyalkyl group containing between 1 and 3 carbon atoms.

The component (b) preferably consists of one, two or more compounds of Formula (II).

According to the invention, in the amine oxides of general Formula (II), $R_1$ is preferably a linear or branched, saturated or unsaturated, alkyl or alkenyl group containing between 10 and 16 carbon atoms, preferably an alkyl or alkenyl group containing between 10 and 14 carbon atoms, more preferably a lauric group (12 carbon atoms) and/or a myristic group (14 carbon atoms).

In a preferred embodiment, in the amine oxides of general formula (II): A is a —COO— or —CONH— group, more preferably —CONH—; $R_2$ is also preferably a methylene (—CH2—) or ethylene (—CH2—CH2—) group. $R_3$ and $R_4$ are also preferably each a methyl group.

In a specially preferred embodiment of the invention the component b) of the composition according to the invention comprises at least two compounds of Formula (II) being the proportion having $R_1$ $C_{12}$ or $C_{14}$ higher than 60 wt %.

In a very specially preferred embodiment of the invention the component b) of the composition according to the invention comprises at least two compounds of Formula (II) being the proportion having $R_1$ $C_{12}$ or $C_{14}$ being higher than 60 wt % wherein x is 0.

In another very specially preferred embodiment of the invention the component b) of the composition according to the invention consists in at least two compounds of Formula (II) being the proportion having $R_1$ $C_{12}$ or $C_{14}$ being higher than 60 wt % wherein x is 0.

Examples of commercially available amine oxides of Formula (II) are those with the commercial reference OXIDET® DM-20 (INCI name Lauramine Oxide), OXIDET® DMCLD (INCI name Cocamine Oxide) OXIDET®DM-246 (INCI name Cocamine Oxide), OXIDET® DM-4 (INCI name Myristamine Oxide), OXIDET® L-75 (INCI name Cocamidopropylamine Oxide), all of them marketed by KAO Chemicals Europe.

The Component (c)

The composition according to the invention comprises component c) which comprises one or more non-ionic surfactants. The general definition and general properties of non-ionic surfactants are well-known by the skilled in the art. The definition in "NONIONIC SURFACTANTS—Chemical Analysis" ISBN 0-8247-7626-7 is incorporated herein by reference.

Examples of non-ionic surfactants according to the invention include like alkanolamides, alkoxylated alkanolamides, alkoxylated trimethyolol propane, alkoxylated 1,2,3-trihydroxy hexane, alkoxylated pentaetrythritol, alkoxylated sorbitol, alkoxylated glycerol fatty acid partial ester, alkoxylated trimethyolol propane fatty acid ester, alkoxylated 1,2,3-trihydroxy hexane fatty acid ester, alkoxylated pentaetrythritol fatty acid ester, alkoxylated sorbitol fatty acid ester, fatty alcohol, fatty alcohol polyglycol ethers, alkylphenol, alkylphenol polyglycol ethers, fatty acid polyglycol esters, fatty acid amide polyglycol ethers, fatty amine polyglycol ethers, mixed ethers and mixed formals, optionally partly oxidized alk(en)yl oligoglycosides or glucuronic acid derivatives, fatty acid-N-alkylglucamides, ethoxylated glucamine derivatives, protein hydrolyzates (particularly wheat-based vegetable products), polyol fatty acid esters, sugar esters, alkyl polyglucosides, sorbitan esters and polysorbates, Cocamide MEA, Cocamide DEA, PEG-4 Rapeseedamide, Trideceth-2 Carboxamide MEA, PEG-5 Cocamide, PEG-6 Cocamide and PEG-14 Cocamide. Examples of commercially available useful non-ionic surfactants according to the invention are AMIDET® N, AMIDET® A15, AMIDET® A/17, AMIDET® A/26, AMIDET® A-111-P, AMIDET® B-112, LEVENOL® H&B, LEVENOL® C-241, LEVENOL® C-301 and LEVENOL® C-201, FEVENOL F200, EMANON XLF, MYDOL®-10, KALCOL, KAOPAN, RHEODOL and LEVENOL type compounds.

In a preferred embodiment the component c) of the composition according to invention comprises one or more non-ionic surfactants of Formula (III):

$$R—(O—CHX—CH_2)_n—Z \qquad \text{Formula (III)}$$

wherein R is a linear or branched, saturated or unsaturated, alkyl chain, having from 1 to 30 carbon atoms, preferably from 4 to 22 carbon atoms, optionally comprising functional groups comprising heteroatoms; X is H or a C1-C3 linear or branched alkyl group, n is 0 or has an average value being a real number higher than 0 and lower than 30, preferably lower than 18, Z is a polar group containing one or more heteroatoms.

In a more preferred embodiment the compound c) of the composition according to the invention comprises one or more compounds of Formula (III) as hereinabove defined wherein R is a linear or branched, saturated or unsaturated, hydrocarbon alkyl chain, having from 1 to 30 carbon atoms, preferably from 4 to 22 carbon atoms, more preferably from 8 to 18, most preferred from 8 to 16, X is H or a C1-C3 linear or branched alkyl group, n is 0 or has an average value being a real number higher than 0 and lower than 30, preferably lower than 18, Z is a polar group containing one or more heteroatoms, preferably Z is OH.

In the most preferred embodiment the compound c) of the composition according to the invention consists in one or more compounds of Formula (III) as hereinabove defined wherein R is a linear or branched hydrocarbon alkyl chain, having from 1 to 30 carbon atoms, preferably from 4 to 22 carbon atoms, more preferably from 8 to 18, most preferred from 8 to 16, X is H or a C1-C3 linear or branched alkyl group, n is 0 or has an average value being a real number higher than 0 and lower than 30, preferably lower than 18, Z is a polar group containing one or more heteroatoms, preferably OH.

Examples of commercially available compounds suitable as component c) in the composition according to the invention include FINDET 10/15 (Polyoxyethylene(3) alkyl(C8-12) ethers), FINDET 10/18 (Polyoxyethylene(5) alkyl(C8-12) ethers), FINDET 1214N/14 (Polyoxyethylene(2) alkyl (C12-14) ethers), FINDET 1214N/15 (Polyoxyethylene(3) alkyl(C12-14) ethers), FINDET 1214N/16 (Polyoxyethylene(2) alkyl(C12-14) ethers), FINDET 1214N/19 (Polyoxyethylene(7) alkyl(C12-14) ethers), FINDET 1214N/21 (Polyoxyethylene(9) alkyl(C12-14) ethers), FINDET 1214N/23 (Polyoxyethylene(11) alkyl(C12-14) ethers), FINDET 12/17 (Polyoxyethylene (5) isotridecyl alcohol), FINDET 13/18.5 (Polyoxyethylene (5.5) isotridecyl alcohol), FINDET 13/21 (Polyoxyethylene (9) isotridecyl alcohol), FINDET 16/36 (Polyoxyethylene(24) alkyl(C16) ethers), FINDET 1618A/18 (Polyoxyethylene(6) alkyl(C16-18) ethers), FINDET 1618A/20 (Polyoxyethylene(8) alkyl (C16-18) ethers), FINDET 1618A/23 (Polyoxyethylene(11) alkyl(C16-18) ethers), FINDET 1618A/35-P (Polyoxyethylene(23) alkyl(C16-18) ethers), FINDET 1618A/52 (Polyoxyethylene(40) alkyl(C16-18) ethers), FINDET 1618A/72-P (Polyoxyethylene(60) alkyl(C16-18) ethers), FINDET 18/27 (Polyoxyethylene(15) alkyl(C18) ethers), FINDET 1816/14 (Polyoxyethylene(1.9) alkyl(C16-18 and C18-unsaturated) ethers), FINDET 1816/18 (Polyoxyethylene(6) alkyl(C16-18 and C18-unsaturated) ethers), FINDET 1816/3220 (Polyoxyethylene(20) alkyl(C16-18 and C18-unsaturated) ethers), FINDET 1816/32-E (Polyoxyethylene(20) alkyl(C16-18 and C18-unsaturated) ethers), FINDET AR/30

(Polyoxyethylene (18) castor oil.), FINDET AR-45 (Polyoxyethylene (33) castor oil), FINDET AR-52 (Polyoxyethylene (40) Hydrogenated castor oil) , FINDET ARH-52 (Polyoxyethylene (40) castor oil), FINDET K-060 (Polyoxyethylene Coconut monoethanolamide), FINDET LI/1990 (Polyoxyethylene (7) fatty branched alcohol), FINDET LN/8750 (Polyoxyethylene (75) lanolin), FINDET LR4/2585 (Polyoxyethylene (13) fatty branched alcohol), FINDET OR/16 (Polyoxyethylene (4 EO) unsaturated fatty acid), FINDET OR/22 (Polyoxyethylene (10) unsaturated fatty acid), FINDET OR/25 (Polyoxyethylene (13) unsaturated fatty acid), FINDET ORD/17.4 (Polyoxyethylene (5,4) unsaturated fatty acid.), FINDET ORD/32 (Polyoxyethylene (20) unsaturated fatty acid), FINDET PG68/52-P (Polyoxyethylene(40) alkyl(C16-18) ethers), FINDET SE-2411 (Polyoxyethylene and polyoxypropylene decyl alcohol), KALCOL 0880 (cetyl alcohol), KALCOL 0898 (Octyl alcohol), KALCOL 1098 (Decyl alcohol), KALCOL 200GD (Octyl dodecanol), KALCOL 2098 (Lauryl alcohol), KALCOL 220-80 (Behenyl alcohol), KALCOL 2450 (Alcohol $C_{10-18}$), KALCOL 2455 (Alcohol $C_{10-18}$), KALCOL 2463 (Alcohol $C_{10-18}$), KALCOL 2470 (Alcohol $C_{12-16}$), KALCOL 2473 (Alcohol $C_{12-16}$), KALCOL 2474 (Alcohol $C_{12-14}$), KALCOL 2475 (Alcohol $C_{12-14}$), KALCOL 4098 (Myristyl alcohol), KALCOL 4250 (Alcohol $C_{12-16}$), KALCOL 6098 (Cetyl Alcohol), KALCOL 6850 (Alcohol $C_{14-18}$), KALCOL 6850 P (Alcohol $C_{14-18}$), KALCOL 6870 (Alcohol $C_{14-18}$), KALCOL 6870 P (Alcohol $C_{16-18}$), KALCOL 8098 (Stearyl alcohol), KALCOL 8665 (Alcohol $C_{16-18}$), KALCOL 8688, FARMIN CS (Coconut amine), FARMIN 08D (Octyl amine), FARMIN 20D (Lauryl amine), FARMIN 80 (Stearyl amine), FARMIN 86T (Stearyl amine), FARMIN O (Oleyl amine), FARMIN T (Tallow amine), FARMIN D86 (Distearyl amine), FARMIN DM24C (Dimethyl coconut amine), FARMIN DM0898 (Dimethyl octyl amine), FARMIN DM1098 (Dimethyl decyl amine), FARMIN DM2098 (Dimethyl lauryl amine), FARMIN DM2463 (Dimethyl lauryl amine), FARMIN DM2458 (Dimethyl lauryl amine), FARMIN DM4098 (Dimethyl myristyl amine), FARMIN DM4662 (Dimethyl myristyl amine), FARMIN DM6098 (Dimethyl palmityl amine), FARMIN DM6875 (Dimethyl palmityl amine), FARMIN DM8680 (Dimethyl stearyl amine), FARMIN DM8098 (Dimethyl stearyl amine), FARMIN DM2285 (Dimethyl behenyl amine), FARMIN M2-2095 (Didodecyl monomethyl amine), DIAMIN R-86 (Hydrogenatecl tallow propylene diamine), DIAMIN RRT (Tallow propylene diamine), FATTY AMIDE S (Stearamide), FATTY AMIDE T (Stearamide), AMIET 102 (Polyoxyethylene alkyl amine), AMIET 105 (Polyoxyethylene alkyl amine), AMIET 105A (Polyoxyethylene alkyl amine), AMIET 302 (Polyoxyethylene alkyl amine), AMIET 320 (Polyoxyethylene alkyl amine), AMIET TD/23 (Polyoxyethylene(11) Tallow amine), AMIET OD/14 (Polyoxyethylene(2) oleyl amine), AMINON PK-02S (Alkyl alkanolamide), AMINON L-02 (Alkyl alkanolamide), AMIDET A-15 (Fatty acid monoethanolamide), AMIDET A111 (Coconut oil fatty acid ethanolamide), AMIDET B-112 (Coconut oil fatty acid diethanolamide), AMIDET B-120 (Linolenic acid diethanolamide), AMIDET KDE (Coconut oil fatty acid diethanolamide), AMIDET SB-13 (Coconut oil fatty acid diethanolamide), FINDET K-060 (Polyoxyethylene Coconut monoethanolamide, marketed by Kao Chemicals Europe and Kao Corporation.

Particularly preferred as component (c) are fatty alcohols.

The component (c) preferably consists of one, two or more compounds.

The Components (d) and (e)

The composition according to the invention comprises water as component (d) and optionally an alkaline additive as component (e). The alkaline additive is compatible with the composition according to the invention without causing precipitation or formula instability for both the diluted and the concentrated form. Suitable alkaline additives include hydroxides, carbonates and bicarbonates.

In a preferred embodiment the component (e) is a hydroxide, more preferably magnesium hydroxide, potassium hydroxide or sodium hydroxide.

The Composition According to the Invention

According to a first aspect the present invention provides a cleaning composition suitable for horizontal and non-horizontal surfaces comprising:

(a) One or more compounds of formula (I)

$$R^1—O—(CH_2—CH(R^2)—O)_n(CH_2CH_2O)_m—X^-(A)_{1/z}^{z+} \quad (I)$$

wherein $Z^-$ is a $CH_2COO^-$ group, $R^1$ is an alkyl or alkenyl chain having from 4 to 30 carbon atoms, $R^2$ is a C1-C3 linear or branched alkyl chain, A is a suitable countercation, n and m are 0 or an integer number between 1 to 30, and wherein the sum of m+n is from 0 to 30, preferably from 1 to 15; z is 1, 2, or 3;

(b) One or more amphoteric surfactants (c) A non-ionic surfactant (d) Water up to 100 wt % with respect to the total amount of the composition;

wherein the molar ratio between the sum of the components (a) and (b) and the component (c), that is ((a)+(b))/c, is from 3 to 16.5, preferably from 3.7 to 15.9, and the molar percentage of the components (a) and (c), calculated taking as a whole the sum of (a)+(b)+(c) are: (a) is from 15 to 60 mol. % and (c) is from 7 to 16 mol. %.

The composition of the present invention preferably comprises an aqueous surfactant composition consisting of components (a) to (d) , optionally together with component (e), which is an alkaline additive.

The composition of the present invention preferably consistes of components (a) to (d), optionally together with component (e), which is an alkaline additive.

In a specially preferred embodiment the composition according to the invention comprises:

(a) An ether carboxylate of formula I.2

$$R^1—O\ (CH_2—CH(R^2)—O)_n(CH_2CH_2O)_m—CH_2COO^-(A)_{1/z}^{z+} \quad (I.2)$$

wherein $R^1$ is a linear or branched, saturated or unsaturated alkyl or alkenyl chain having from 4 to 22 carbon atoms, preferably between 10 and 18 carbon atoms, more preferably between 12 and 14 carbon atoms; $R^2$ is a C1-C3 linear or branched alkyl chain, A is a suitable countercation, n and m are 0 or an integer number between 1 to 30, and wherein the sum of m+n is from 1 to 30, preferably from 1 to 15; preferably m is not higher than 2 and m+n is not higher than 12, and wherein z is 1 or 2;

(b) One or more amphoteric surfactants, preferably one amine oxide (c) A non-ionic surfactant (d) Water up to 100 wt % with respect to the total amount of the composition;

wherein:

the molar ratio between the sum of the components (a) and (b) and the component (c), that is ((a)+(b))/c) , is from 3 to 16.5, preferably from 3.7 to 15.9, more preferably from 5.2 to 13.2.

In a preferred embodiment of the invention the composition according to the invention the molar percentange of the components (a) and (c), calculated taking as a whole the sum of (a)+(b)+(c) are: (a) is from 15 to 60 molar % and (c) is from 7 to 16 molar % and the molar percentage of the components (b) and and (c), calculated taking as a whole the sum of (a)+(b)+(c) are: (b) is from 50 to less than 100 molar % and (c) is from 7 to 15 molar %.

In a preferred embodiment the surface tension measured for a dilution of a composition according to the invention measured at a dilution of 0.5 wt. % Active Matter content (i.e. the sum of (a), (b) and (c)) is lower than 28 mN/m, more preferably lower than 26 mN/M, even more preferred lower than 25 mN/m.

According to the present invention, preferred embodiments may be combined to provide even more preferred embodiments. For example, a particularly preferred embodiment of component (a) may be combined with a particularly preferred embodiment of component (b) and/or (c), a particularly preferred embodiment of component (b) may be combined with a particularly preferred embodiment of component (a) and/or (c), and a particularly preferred embodiment of component (c) may be combined with a particularly preferred embodiment of component (a) and/or (b).

One even more particularly preferred embodiment of the invention is a cleaning composition suitable for horizontal and non-horizontal hard surfaces comprising a surfactant basis consisting of (a), (b) and (c) as hereinabove defined wherein the molar ratio between the sum of components (a) and (b) and component (c), i.e. ((a)+(b))/c), if from 3 to 16.5, preferably from 3.7 to 15.9, more preferably from 5.2 to 13.2.

The present invention also provides a concentrated cleaning composition according to the invention as hereinabove defined, characterized in having an active matter corresponding to the sum of the active matter of components (a), (b) and (c) from 15.0 to 90.0 wt. % active matter. The concentrated cleaning composition has preferably a pH in the range of 5 to 9, preferably 6-7.

The present invention further provides a diluted cleaning composition according to the invention as hereinabove defined, optionally comprising an alkaline additive and characterized in having an active matter corresponding to the sum of the active matter of components (a), (b) and (c) from 1.5 to less than 15.0 wt. % active matter. The diluted cleaning composition has preferably a pH in the range of 7 to 14, preferably 14.

The present invention provides a highly diluted cleaning composition according to the invention as hereinabove defined, optionally comprising an alkaline additive and characterized in having an active matter corresponding to the sum of the active matter of components (a), (b) and (c) is from 0.01 to 3.0 wt. % active matter, preferably from 0.1 to 0.6 wt. % active matter, being suitable to generate a cleansing foam without further dilution. The highly diluted cleaning composition has preferably a pH in the range of 8 to 13, preferably 10-13, more preferably 13 or higher.

In another aspect, the present invention provides a method to prepare a concentrated, a diluted or a highly diluted cleansing composition according to the invention as hereinabove defined. These compositions can be prepared by dissolving the components (a), (b), and (c) in water, preferably under stirring and heating. The diluted composition is preferably prepared by diluting the concentrated composition with water such as tap water; and the highly diluted composition is preferably prepared by diluting the diluted composition with water such as tap water.

The diluted or highly diluted compositions can be foamed with air. The present invention thus also provides a corresponding foam.

In a further aspect, the present invention provides a method of cleaning and optionally disinfecting horizontal and/or non-horizontal surface comprising contacting said surface with a high retention foam generated by using a diluted or a highly diluted, preferably a highly diluted, cleaning composition as hereinbefore defined.

The composition according to the invention is preferably used in the form of a foam, for instance to clean tile surfaces or metallic surfaces which require efficient cleaning and optionally disinfection, like those surfaces of walls and machinery of industrial meat production. However, the composition according to the invention could be used in other situations where alkaline cleaners having good stability properties, feasible dilution behavior, and stable foam properties could be needed, for instance as marine cleaners, home care cleaning products, etc.

Preferably the method to generate a foam cleaner using a composition according to the invention comprises the steps herein below defined. To apply the composition according to the invention over vertical or non-horizontal surfaces (walls, working tables, floors, ceilings and devices), a portable or fixed device (installed in the room) is used to generate the foam. The composition suitable to generate the foam generator shall be in a diluted foam (active matter lower than 3 wt. %, preferably lower than 0.6 wt. %). The dilution can be made prior to use or at the very moment of the application, meaning that the foaming generator devices includes a system that allows the composition according to the invention to be introduced at relatively high concentration and to be diluted to the suitable concentration for foam generation. Usually the foam generator device delivers the foam to a container and the foam is pumped to and put in contact with the surface to be treated.

In one embodiment of the invention, the composition according to the invention is used to generate a foam suitable to be used in industrial cleaning of surfaces method comprising the following steps:

1. Collection of the biggest particles (i.e. meat) by mechanical ways from the surfaces to be cleaned.
2. Washing the surfaces by applying medium-pressure water to remove medium particles (10-25 bar), to avoid microorganisms be spread to the entire chamber.
3. Foam cleaner generated with a composition according to the invention is sprayed everywhere and left to act for some time (i.e. 10-20 min). The foaming product is applied on the wall from the bottom to the top because walls are dirtier at the bottom.
4. Rinse with water
5. Disinfection
6. Rinse with water (After the cleaning/disinfecting, the surfaces are rinsed off with fresh tap water)

During the application one has to be careful about not creating too much aerosol effect (that happens when air to solution ratio is high) as products are highly alkaline and they can be harmful when breathed by the worker.

Cleaning and disinfection can be done at the same time, therefore the steps 5 and 6 are not required, it usually depends on the final application. Disinfection and final rinse are not always done.

Additives to the composition according to the invention

The composition according to the invention can comprise other components aimed to improve the cleaning ability of the composition or the disinfecting properties.

Disinfecting Agents

The cleaning composition according to the invention can comprise disinfecting agents in order to improve the disinfection ability of the surfaces to be treated. Suitable disinfecting agents according to the invention include any organic or inorganic compounds with antimicrobial activity. Examples of suitable antimicrobial agents according to the invention are phenols and derivatives; organic and inorganic acids, their esters and salts (acetic acid, propionic acid, undecanoic acid, sorbic acid, lactic acid, benzoic acid, salicylic acid, dehydroacetic acid, sulphur dioxide, sulphites, bisulphites); alcohols (ethanol, iso-propanol, n-propanol, methanol, benzyl alcohol, etc) and peroxides (hydrogen peroxide, peracetic acid, benzoyl peroxide, sodium perborate, potasium permanganate, etc.). More preferred suitable antimicrobial agents are those compatible with alkaline conditions as, for instance, aldehydes (formaldehyde, glutaraldehyde, glyoxal); quaternary ammonium compounds-quats (benzalconium chloride, cetylpiridinium chloride, didecyldimethylammonium chloride, etc); Chlorine based derivatives such as chloramines, dichloroisocianurates, chloroform and chlorine releasing compounds (i.e: sodium hypochlorite); Iodine based compounds (free iodine, iodophors and iodoform); metals and salts (cadmium, silver, copper, etc). The selection of the suitable disinfecting agent can be made by the skilled in the art taking into consideration the specific characteristics of the target use of the composition according to the invention.

Builders

The cleaning composition according to the invention can comprise builders which could contribute to pH adjustment and contain the effects of water hardnesss on surfactants. In addition, due to their ability to form coordination complexes with metal cations, builders provide protection to surface corrosion. Examples of builders suitable for the composition according to the invention include hydroxides, carbonates, bicarbonates, silicates, borates, zeolites, phosphates, citrates, polycarboxylates and the like. Some builders like EDTA and nitrilotriacetate might contribute to trap heavy metal cations.

Biocides

The composition according to the invention can comprise certain amounts of biocides in order to prevent biological oxidations in tanks at certain conditions. However, the possibility of having alkaline pHs and highly concentrated compositions involve the compositions according to the invention to be normally stable to biological oxidation without needing the addition of additional biocides.

Corrosion Inhibitors

The composition according to the invention can comprise certain amounts of corrosion inhibitors suitable for the application.

Organic Solvents

The composition according to the invention can comprise certain amounts of organic solvents. Examples of suitable alcohols include short chain organic alcohols, aromatic alcohols, glycol ethers, glycols and alcohol amines.

Perfumes, Colorant, Dyes or Other Masking Agents

The composition according to the invention might contain certain amounts of perfumes, colorants or dyes intended to improve its appearance or intended to enable the visual detection of the presence of the composition according to the invention. In some cases, it might comprise also some odour masking agents intended to improve the odorizing properties.

The following examples are given in order to provide a person skilled in the art with a sufficiently clear and complete explanation of the present invention, but should not be considered as limiting of the essential aspects of its subject, as set out in the preceding portions of this description.

Hydrotopes

The composition according to the invention might comprise certain amounts of one or more hydrotopes intended to enhance the solubility of certain substances. Examples of suitable hydrotopes to be used in the composition according to the invention are ethanol, isopropanol, propyleneglycol and polyethylene glycol ethers. Preferably, p-toluene sulfonates, xylene sulfonates and cumene sulfonates, preferably in the form of their sodium salts.

EXPERIMENTAL SECTION

1. Compositions Tested According to the Invention (Ingredients and Preparation Method)

Table 1 provides the details of cleaning compositions according to the invention (1-3) and comparative examples (C1-C4 and C7).

The surface tension is measured with the Wilhelmy plate method with a KRUSS K12 tensiometer at 25° C., on a 10 wt. % aqueous dilution prepared from the formulations listed in the table using deionized water, thus on aqueous solutions containing 0.5 wt. % of total surfactant ingredient.

The preparation of the compositions is carried out as follows: Suitable amounts of sodium hydroxide and deionized water are provided into a beaker, agitating until complete dissolution, followed by the incorporation of the required amounts of surfactants specified for every composition, to obtain a total content of surfactant ingredient of 5% (as active matter). Mixture is stirred and submitted to a gentle heating (50-60° C.) until complete homogenization.

TABLE 1

| Compositions | | | | | | |
|---|---|---|---|---|---|---|
| Reference | Components (*) | (a + b):c | a:b | a:c | Total NaoH (wt %) | Surface tension |
| 1 | (a1): 18.3 mol. %<br>(b1): 69.7 mol. %<br>(c1): 12.0 mol. % | 7.33 | 0.26 | 1.53 | 5 | 24.8 |
| 2 | (a1): 55.7 mol. %<br>(b1): 30.6 mol. %<br>(c1): 13.7 mol. % | 6.30 | 1.82 | 4.07 | 5 | 24.0 |
| 3 | (a2): 49.4 mol. %<br>(b2): 38.8 mol. %<br>(c1): 11.8 mol. % | 7.47 | 1.27 | 4.19 | 5 | 24.9 |
| C7 | (a3): 17.0 mol. %<br>(b1): 70.0 mol. %<br>(c1): 13.0 mol. % | 6.69 | 0.24 | 1.31 | 0 | 24.7 |
| C1 | (a2): 39.9 mol. %<br>(b1): 55.6 mol. %<br>(c1): 4.4 mol. % | 21.7 | 0.72 | 9.07 | 5 | 30.1 |
| C2 | (a2): 49.0 mol. %<br>(b1): 20.2 mol. %<br>(c1): 30.9 mol. % | 2.24 | 2.43 | 1.59 | 5 | 23.0 |
| C3 | (a4): 71.0 mol. %<br>(c1): 29.0 mol. % | 2.45 | | 2.44 | 5 | |
| C4 | (a4): 71.0 mol. %<br>(c1): 29.0 mol. % | 2.45 | | 2.44 | 0 | 23.1 |

(*) All mol. % values are based on the total molar amount of (a), (b), and (c). The following compounds were used:
(a1): C12/14 ether carboxylic (average ethoxylation: 4.5 EO mols)
(a2): C12/14 ether carboxylic (average ethoxylation: 2.5 EO mols)
(a3): C12/14 ether sulphate (average ethoxylation: 2.7 EO mols), sodium salt
(a4): C12/14 sulphate; sodium salt.
(b1): C12/C14 dimethyl amine oxide,
(b2): Cocoamido propyl betaine
(c1): C12/14 alcohol 2. Performance Tests: Aspect (Related to the Stability), Viscosity and Foam Table 2 details the aspect (related to the stability) and the viscosity of the compositions according to the invention (1-3) and of the comparative examples (C1-C4 and C7).

The aspect and the viscosity parameters are measured for the 5% active formulations (diluted formulations according to the invention) and also for the dilutions of these formulations using distilled water in order to have 0.5% active matter formulations (highly diluted formulations according to the inventions).

Aspect is visually assessed at room temperature after 1 day from the preparation for the compositions stored at room temperature.

Viscosity is measured on a Brookfield LV viscometer at 20° C., with the appropriate spindle and speed (rpm) combination.

Table 3 details the behavior and features of foam generated from the compositions tested. The tests were performed using 10% aqueous dilution of the compositions. The measurements correspond therefore to 0.5% active matter formulations (highly diluted formulations according to the inventions).

Evaluation of foam performance is carried out by the semi-quantitative procedure described herein below.

A tiled vertical wall is covered with the diluted formula using a portable pump-up foamer model 900-2PU from DEMA Europe. The tiled vertical wall consists of 5×5 shiny white tile (tile size is approximately 20 cm×20 cm). Percentage of the surface covered by the product in every one of the central tiles (3×3) of the treated surface is visually assessed by at least one experienced person. Global value "% of foam retention" corresponds to the average value of the 9 tiles under assessment after 5 and 10 min after application. The aspect of the foam is visually inspected and characterized as dense or liquid consistency. Products giving a good behavior provide dense foams. Products with bad performance produce foam with a liquid consistency. The complete evaluation is performed at room temperature (between 20° C. and 25° C.)

As can be seen from the results in Table 2 and Table 3, only the compositions according to the invention accomplish all the desirable requirements by providing: i) low viscosity, stable compositions at concentrated, diluted and highly diluted concentrations; and ii) good foam quality exhibiting long retention times, easy rinse and suitable density. Comparative example C3 provides a good foam behavior, but it is not a suitable formulation in terms of feasibility and stability.

TABLE 2

Appearance and viscosity of the compositions

| | Aspect 1 day RT | | Viscosity (**) | |
|---|---|---|---|---|
| Reference | AM = 5% | AM = 0.5% (*) | AM = 5% | AM = 0.5% (*) |
| 1 | ○ | ○ | 40 | 4 |
| 2 | ○ | ○ | 5 | 5 |
| 3 | ○/Δ | ○/Δ | 495 | 5 |
| C7 | ○ | ○/Δ | 20 | 4 |
| C1 | ○ | ○ | 5 | <1 |
| C2 | Δ | Δ | 15 | <1 |

TABLE 2-continued

Appearance and viscosity of the compositions

| | Aspect 1 day RT | | Viscosity (**) | |
|---|---|---|---|---|
| Reference | AM = 5% | AM = 0.5% (*) | AM = 5% | AM = 0.5% (*) |
| C3 | XX | XX | — | <1 |
| C4 | X | X | — | <1 |

(*) The pH of the diluted compositions is 13
(**) Viscosity measurement at spd/rpm of 1/60.
Key for Aspect:
○ = clear and homogeneous
○/Δ = slightly cloudy and homogeneous
Δ = cloudy
X = whitish - phase separation
XX = whitish with lumps

TABLE 3

Foam Quality tests

| Reference | Foam Quality | % Foam Retention (5') | % Foam Retention (10') |
|---|---|---|---|
| 1 | D | 100 | 97 |
| 2 | D | 84 | 68 |
| 3 | D | 93 | 73 |
| C7 | D | 96 | 78 |
| C1 | D | 4 | 0 |
| C2 | L | 2 | 0 |

Key for Foam Quality:
D: (good) dense foam
L: (bad) liquid consistency

3. Evaluation of Water Hardness Effects

The compositions according to the invention 1 and 2 and the comparative composition C3 where used to prepare highly diluted compositions (AM=0.5%) using hard water (20°HF) and distilled water (0° HF).

Aspect of the highly diluted compositions and the foam quality features where evaluated by the procedures described above. As can be seen the compositions according to the invention perform good results in both distilled and hard water which is not case for the comparative example.

TABLE 4

| | Distilled Water (0° H) | | | | Hard Water (20° H) | | | |
|---|---|---|---|---|---|---|---|---|
| | Aspect | Foam | % Foam retention | | Aspect | Foam | % Foam retention | |
| Ref | (RT) | quality | 5' | 10' | (RT) | quality | 5' | 10' |
| 1 | ○ | D | 100 | 100 | ○/Δ | D | 100 | 89 |
| 2 | ○ | D | 100 | 88 | ○/Δ | D | 100 | 90 |
| C3 | Δ | D | 90 | 55 | Δ | L | 9 | 0 |

Note:
Water hardness of 20° HF corresponds to 544 ppm $Ca^{2+}$ and 156 ppm $Mg^{2+}$; The key for Foam quality and Aspect symbols interpretation is the same than in Table 2 and 3.

4. Concentrated Compositions

The advantages of the compositions according to the invention to prepare concentrated compositions have been evaluated. Table 5 provides the stability related features of a composition according to the invention (5) and two comparative examples (C5 and C6). The components and ratios of composition 5 correspond to composition 1 in Table 1. The components and ratios of compositions C5 and C6 correspond to those of composition C3 in Table 1.

The preparation of these concentrate compositions consists in the addition of the required quantities of surfactants followed by water while stirring until complete homogenization. To facilitate the mixing process, the preparation vessel containing the mixture is heated between 50-70° C. until a uniform product is obtained, following by cooling until room temperature. pH of the formulation is adjusted in order the appearance of the composition is clear at the moment is prepared.

TABLE 5

| Ref | Active Matter | pH | Aspect (RT) | Viscosity (20° c.)/cps |
|---|---|---|---|---|
| 5 | 42 | 6.8 | Clear and Homogeneous | 3800 |
| C5 | 42 | 7.8 | White paste | 136000 (*) |
| C6 | 18 | 7.8 | Separate White paste | 4200 |

(*) BROOKFIELD HAT-DV-II (spdE, 5 rpm) equipped with Helipath

The results in Table 5 show that concentrated compositions according to the invention are stable and have a homogeneous and clear aspect one day after from preparation and exhibit good viscosity value (fluid material).

5. Hypochlorite Bleaches

The suitability of the compositions according to the invention to prepare disinfecting formulations comprising sodium hypochlorite as disinfecting agent has been evaluated.

A diluted composition according to the invention (example 6) is prepared using analogous surfactants and ratios as those used in example 1 as indicated in _Table 1, by adding to deionized water the required amount of surfactants to reach a total quantity of 5% (as active matter). The mixture is stirred until complete homogenization and afterwards the suitable amount of sodium hypochlorite is added to have a final content of 3 wt %. The pH is adjusted between 12-13 units by addition of a suitable amount of NaOH. The features of this diluted composition as well as the quality parameters of the foam generated a highly diluted composition prepared from the diluted composition by 10% dilution are shown in Table 6.

TABLE 6

| Diluted composition (5% AM) | | Highly diluted composition (0.5% AM) | | | | |
|---|---|---|---|---|---|---|
| NaOH: 0.3% | | | | | % Foam Retention | |
| Aspect (1 day/RT) | Viscosity (20° C.) cps | Aspect (1 day/RT) | pH | Foam Quality | 5' | 10' |
| ○ | 50 | ○ | 12 | D | 76 | 56 |

The invention claimed is:

1. A cleaning composition suitable for horizontal and non-horizontal surfaces comprising:

(a) an ether carboxylate of the formula $$R^1—O—(CH_2—CH(R^2)—O)_n(CH_2CH_2O)_m—CH_2COO^-(A)_{1/z}^{z+}$$

wherein $R^1$ is a linear or branched, saturated or unsaturated, alkyl or alkenyl chain having from 12 to 14 carbon atoms; $R^2$ is a C1-C3 linear or branched alkyl chain; A is a suitable countercation; n and m are 0 or an integer number between 1 to 15, and wherein the sum of m+n is from 1 to 15; and z is 1, 2, or 3;

(b) an alkyl amidopropyl betaine or an amine oxide of formula (II)

Formula (II)

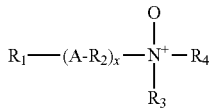

wherein $R_1$ represents a linear or branched, saturated or unsaturated alkyl or alkenyl group containing between 10 and 14 carbon atoms;

$R_2$ represents an alkylene group containing between 1 and 6 carbon atoms;

A represents a group selected from —COO—, CONH—, —OC(O)— and —NHCO—;

x represents 0;

and $R_3$ and $R_4$ independently of one another represent an alkyl group containing between 1 and 3 carbon atoms;

(c) a C12/14 alcohol;

(d) water up to 100 wt % with respect to the total weight of the composition; wherein the molar ratio between the sum of components (a) and (b) and component (c), that is ((a)+(b))/(c), is from 3 to 16.5; and the molar percentage of the components (a) and (c), calculated taking as a whole the sum of (a)+(b)+(c) are: (a) is from 15 to 60 mol. % and (c) is from 7 to 16 mol .%.

2. The composition according to claim 1 wherein the molar percentage of the components (b) and (c), calculated taking as a whole the sum of (a)+(b)+(c) are: (b) is from 50 to less than 100 molar % and (c) is from 7 to 16 molar %.

3. The composition according to claim 2, wherein the molar ratio between the sum of components (a) and (b) and component (c), that is ((a)+(b))/(c), is from 5.2 to 13.2.

4. The composition according to claim 1 wherein the surface tension measured for a dilution of a composition according to the invention measured at a dilution of 0.5% active matter is lower than 28 mN/m.

5. The composition according to claim 1 characterized in having an active matter content corresponding to the sum of the components (a), (b) and (c) from 15.0 to 90.0 wt. %.

6. The composition according to claim 1, characterized in having an active matter content corresponding to the sum of components (a), (b) and (c) from 1.5 to less than 15.0 wt. %.

7. The composition according to claim 1, characterized in having an active matter content corresponding to the sum of components (a), (b) and (c) from 0.01 to less than 1.5 wt. % active matter, and the composition is suitable to generate a cleansing foam without further dilution.

8. The composition of claim 1, further comprising an alkaline additive, wherein the alkaline additive does not cause precipitation of the components.

9. The composition of claim 6 in the form of a foam.

10. The composition of claim 7 in the form of a foam.

11. A cleaning composition suitable for horizontal and non-horizontal surfaces comprising:

(a) an ether carboxylate of the formula $$R^1—O—(CH_2—CH(R^2)—O)_n(CH_2CH_2O)_m—CH_2COO^-(A)_{1/z}^{z+}$$

wherein $R^1$ is a linear or branched, saturated or unsaturated, alkyl or alkenyl chain having from between 12 and 14 carbon atoms; $R^2$ is a C1-C3 linear or branched alkyl chain, A is a suitable countercation, n and m are 0 or an integer number between 1 to 15, and wherein the sum of m+n is 1 to 15; and z is 1, 2, or 3;

(b) an alkyl amidopropyl betaine or an amine oxide of formula (II)

Formula (II)

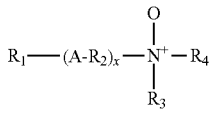

wherein $R_1$ represents a linear or branched, saturated or unsaturated alkyl or alkenyl group containing between 10 and 14 carbon atoms;

$R_2$ represents an alkylene group containing between 1 and 6 carbon atoms;

A represents a group selected from —COO—, CONH—, —OC(O)— and —NHCO—;

x represents 0;

and $R_3$ and $R_4$ independently of one another represent an alkyl group containing between 1 and 3 carbon atoms (c) a C12/14 alcohol;

(d) water up to 100 wt % with respect to the total weight of the composition wherein the molar ratio between the sum of components (a) and (b) and component (c), that is ((a)+(b))/(c), is 3.7 to 15.9, and the molar percentage of the components (a) and (c), calculated taking as a whole the sum of (a)+(b)+(c) are: (a) is from 15 to 60 mol. % and (c) is from 7 to 16 mol. %.

12. The composition according to claim 11 wherein the molar percentage of the components (b) and (c), calculated taking as a whole the sum of (a)+(b)+(c) are: (b) is from 50 to less than 100 molar % and (c) is from 7 to 16 molar %.

13. A method of cleaning and optionally disinfecting a horizontal and/or non-horizontal surface comprising contacting the surface with the composition of claim 1, characterized as having an active matter content corresponding to the sum of components (a), (b), and (c) from 0.01 to 15 wt. %, and wherein the composition is in the form of a foam.

14. The method of claim 13, wherein the surface tension measured for a dilution of the composition measured at a dilution of 0.5% active matter is lower than 26 mN/m.

15. The method of claim 13, wherein component (b) of the composition is an amine oxide.

16. The method of claim 13, wherein the composition further comprises an alkaline additive, wherein the alkaline additive does not cause precipitation of the components.

17. The method of claim 13, wherein the composition is characterized by an active matter content corresponding to the sum of components (a), (b) and (c) of from 0.1 to 0.6 wt. %.

* * * * *